United States Patent [19]

Kim

[11] Patent Number: 4,925,082

[45] Date of Patent: May 15, 1990

[54] STAPLER WITH INDICATOR WINDOWS

[76] Inventor: Kwang-Shick Kim, #551, Dockpoong-7 Ri, Dongbu-Up, Kwangju-Gun, Kyungki-Do, Rep. of Korea

[21] Appl. No.: 375,831

[22] Filed: Jul. 5, 1989

[30] Foreign Application Priority Data

Jul. 6, 1988 [KR] Rep. of Korea ..... 88-11041

[51] Int. Cl.[5] ..... B25S 5/02; B25F 7/00

[52] U.S. Cl. ..... 227/120; 206/340; 227/156

[58] Field of Search ..... 206/340; 227/77, 19, 227/120, 127, 128, 136, 156

[56] References Cited

U.S. PATENT DOCUMENTS

| | | | |
|---|---|---|---|
| 2,224,461 | 12/1940 | Obstfeld | 206/340 |
| 2,776,431 | 1/1957 | Strong | 227/120 |
| 4,506,819 | 3/1985 | Rand | 227/120 |

*Primary Examiner*—William Price

*Attorney, Agent, or Firm*—Mathews, Woodbridge & Collins

[57] ABSTRACT

A cover case, made from transparent synthetic resin, includes in the surface of the case two kinds of magnifying windows. Through the windows, the binding position can be easily seen and the time for replenishing the staples can be easily found.

1 Claim, 1 Drawing Sheet

STAPLER WITH INDICATOR WINDOWS

BACKGROUND OF THE INVENTION

1. Field of the Invention

This invention relates to a novel stapler which comprises a magnifying window for a scale and a magnifying window for staples. The windows located in a cover made from transparent synthetic resin.

2. Description of the Prior Art

In the conventional stapler, a controller sliding along the scale of the base is mounted to constantly maintain the binding position. To fix the binding position, manual operation of the controller is needed every time, and to make an additional controller means, the product cost is also increased. Whether staples remain in the magazine cannot be determined in the conventional stapler without opening it.

SUMMARY OF THE INVENTION

The purpose of this invention is to solve the above mentioned problems and to furnish a convenient stapler. A cover case is made from transparent synthetic resin, and the surface of the case has two kinds of magnifying windows. Through the windows, the binding position can be easily seen and the time for replenishing the staples can be easily found.

DESCRIPTION OF THE PREFERRED EMBODIMENT

Figure 1:
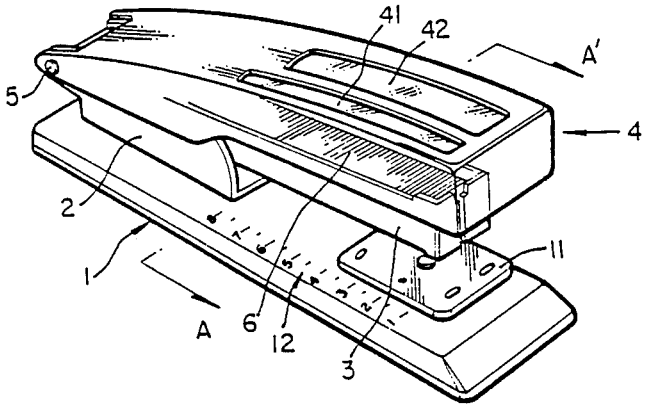
FIG. 1 shows a perspective view of the stapler.

A magazine 3 and a cover case 4 are pivotally mounted at the frame 2 on the base 1 by the pin 5. An anvil portion 11 is attached to the base 1. A scale 12 is printed on the longer edge of the base 1. In the magazine 3, the rail 7 is positioned to slide the staple-stick-pusher 8 connected with the spring 9. The stapler further includes a drive blade 21 and a plate spring 22.

The cover case 4 is made from transparent synthetic resin and the surface of the case 4 has two kinds of magnifying windows. One magnifying window 42 is for viewing staples 6 to find the time of furnishing the staples 6. The other magnifying window 41 is for viewing the scale 12 to determine the binding position of files 23.

Figure 2:
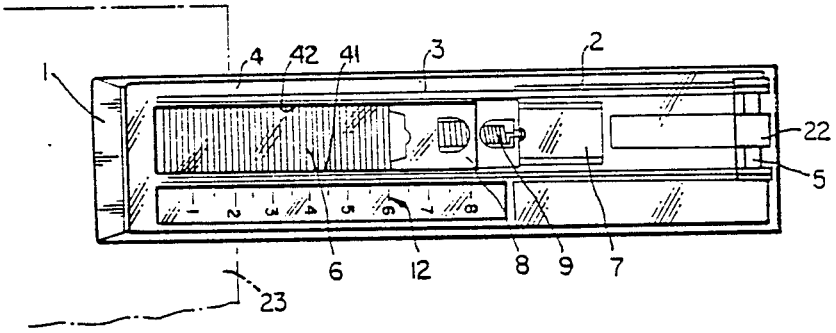
FIG. 2 shows a plan view of the stapler.
Figure 3:
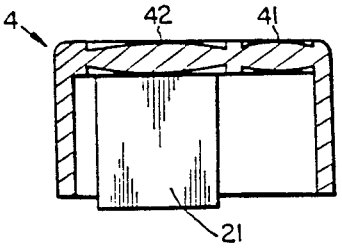
FIG. 3 shows a sectional view taken along the line A—A of FIG. 1.

As shown in FIG. 3, the two magnifying windows have round-form surfaces. As shown in FIG. 2, the staples 6 and the scale 12 are shown through the transparent cover case 4. Through the magnifying window 42, the staples 6 are shown as a magnified figure, and through the magnifying window 41, the scale 12 is also shown as a magnified figure.

The operation of the stapler is the same as that of conventional staplers. To bind the files 23, the edge of the files 23 are deposited on the desired number of the scale 12, and the files 23 are bound at the desired position. The other side of the files 23 are also bound at the same position. The magnifying window 41 is useful to find the desired position of the files 23 and the magnifying window 42 is useful to find whether staples 6 remain.

I claim:

1. A stapler which comprises a magazine and a cover case pivotally mounted at the frame on the base, where the scale is printed on the longer edge, the improvement comprising:

(a) a cover case made from transparent synthetic resin;

(b) two magnifying windows on the surface of the cover case;

a magnifying window to find the time for replenishing staples; and, a magnifying window to determine the binding position.

* * * * *